US010037000B2

(12) United States Patent
Torii et al.

(10) Patent No.: US 10,037,000 B2
(45) Date of Patent: Jul. 31, 2018

(54) CARTRIDGE

(71) Applicant: CANON KABUSHIKI KAISHA, Tokyo (JP)

(72) Inventors: Go Torii, Mishima (JP); Naoya Asanuma, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/403,508

(22) Filed: Jan. 11, 2017

(65) Prior Publication Data

US 2017/0205764 A1 Jul. 20, 2017

(30) Foreign Application Priority Data

Jan. 18, 2016 (JP) ..... 2016-007070

(51) Int. Cl.
*G03G 15/08* (2006.01)
*G03G 21/18* (2006.01)

(52) U.S. Cl.
CPC ..... *G03G 21/1832* (2013.01); *G03G 15/0898* (2013.01); *G03G 15/0817* (2013.01)

(58) Field of Classification Search
CPC ..... G03G 15/0817; G03G 21/1832
See application file for complete search history.

(56) References Cited

U.S. PATENT DOCUMENTS 5,701,558 A 12/1997 Kojima
8,121,517 B2 2/2012 Asanuma et al.
8,139,972 B2 3/2012 Abe et al.
8,270,876 B2 9/2012 Morioka et al.
8,369,744 B2 2/2013 Asanuma et al.
8,688,004 B2 4/2014 Asanuma et al.
2006/0245783 A1 11/2006 Kamimura et al.
2007/0086805 A1 4/2007 Matsushita et al.
2014/0112686 A1 4/2014 Asanuma et al.
(Continued)

FOREIGN PATENT DOCUMENTS

JP 3093918 B2 10/2000
JP 2003-270936 A 9/2003
(Continued)

OTHER PUBLICATIONS

You et al. (JP 2003-270936 A), Sep. 2003, JPO Computer Translation.*

*Primary Examiner* — Erika J Villaluna
(74) *Attorney, Agent, or Firm* — Fitzpatrick, Cella, Harper & Scinto

(57) ABSTRACT

A cartridge includes a frame; a rotatable member for carrying a developer; a blade member contacting the rotatable member; a first seal member provided extended in a rotational axis direction of the rotatable member between the blade member and the frame so as to contact the blade member and the frame; a second seal member provided extended in a direction crossing the rotational axis direction of the rotatable member between the rotatable member and the frame so as to have a first surface contacting the first seal member; and a second surface provided on the frame and extended in a direction crossing the rotational axis direction of the rotatable member so as to contact the first seal member. The first seal member includes a portion sandwiched between the first surface and the second surface with respect to the rotational axis direction.

11 Claims, 14 Drawing Sheets

(56) References Cited

U.S. PATENT DOCUMENTS

| | | | |
|---|---|---|---|
| 2016/0223950 | A1 | 8/2016 | Kato et al. |
| 2017/0003645 | A1 | 1/2017 | Kawakami et al. |

FOREIGN PATENT DOCUMENTS

| | | | | |
|---|---|---|---|---|
| JP | 2003270936 | A | * | 9/2003 |
| JP | 2006-308801 | A | | 11/2006 |
| JP | 2007-093950 | A | | 4/2007 |

* cited by examiner (a)

(b)

(a)

C - C (b)

(a)

(b)

CARTRIDGE

FIELD OF THE INVENTION AND RELATED ART

The present invention relates to a cartridge for use with a process cartridge and an image forming apparatus which include the cartridge. Here, the process cartridge is prepared by integrally assembling a photosensitive drum and a process means actable on the photosensitive drum into a cartridge (unit) and is detachably mountable to an image forming apparatus main assembly. For example, a process cartridge prepared by integrally assembling an electrophotographic photosensitive drum and, as the process means, at least one of a developing means, a charging means and a cleaning means into a cartridge can be used.

As the image forming apparatus, for example, an electrophotographic copying machine, an electrophotographic printer (LED printer, laser beam printer or the like), a facsimile apparatus, a word processor, and so on are included.

In the electrophotographic image forming apparatus, a photosensitive drum generally of a drum type as an image bearing member is electrically charged uniformly. Then, the charged photosensitive drum is subjected to selective exposure to light, whereby an electrostatic latent image (electrostatic image) is formed. Then, the electrostatic latent image formed on the photosensitive drum is developed into a toner image with toner as a developer carried on a developing roller. Thereafter, the toner image is transferred from the photosensitive drum onto a recording material such as a recording sheet or a plastic sheet, and then heat and pressure are applied to the toner image transferred on the recording material, so that the toner image is fixed on the recording material and thus image recording is effected.

Such an image forming apparatus requires toner supply and maintenance of various process means in general. In order to facilitate the toner supply and the maintenance, a process cartridge type in which the photosensitive drum, the charging means, the developing means, the cleaning means and the like are integrally assembled into a cartridge (unit) in a frame and the cartridge is used as a process cartridge detachably mountable to an image forming apparatus main assembly has been put into practical use.

According to this process cartridge type, the maintenance of the image forming apparatus can be made by a user himself (herself), and therefore operativity can be remarkably improved, so that it is possible to provide an image forming apparatus excellent in usability. For that reason, the process cartridge type has been widely used in the image forming apparatus.

As a toner seal(ing) constitution at each of end portions of a blade contacting a rotatable member such as the photosensitive drum or the developing roller, a constitution in which an end portion seal member is contacted to an edge portion of the blade has been disclosed in Japanese Patent No. 3093918. By this, at the end portions of the blade, it is possible to prevent toner leakage from a boundary between the blade and the end portion seal member.

However, in some cases, the toner leaked out from the neighborhood of a blade seal member (first seal member) for sealing between the blade and the frame.

SUMMARY OF THE INVENTION

A principal object of the present invention is to provide a cartridge, for use with a process cartridge and an image forming apparatus, capable of improving a toner sealing force by strongly and hermetically contacting a first seal member and a second seal member each other at a boundary between the first and second seal members.

According to an aspect of the present invention, there is provided a cartridge detachably mountable to a main assembly of an image forming apparatus, comprising: a frame; a rotatable member, supported by the frame, for carrying a developer; a blade member contacting the rotatable member; a first seal member provided extended in a rotational axis direction of the rotatable member between the blade member and the frame so as to contact the blade member and the frame; a second seal member provided extended in a direction crossing the rotational axis direction of the rotatable member between the rotatable member and the frame so as to have a first surface contacting the first seal member; and a second surface provided on the frame and extended in a direction crossing the rotational axis direction of the rotatable member so as to contact the first seal member, wherein the first seal member includes a portion sandwiched between the first surface and the second surface with respect to the rotational axis direction.

Further features of the present invention will become apparent from the following description of exemplary embodiments with reference to the attached drawings.

DESCRIPTION OF THE EMBODIMENTS

Embodiments of the present invention will be described in detail with reference to the drawings.

First Embodiment (Image Forming Apparatus)

Figure 2:
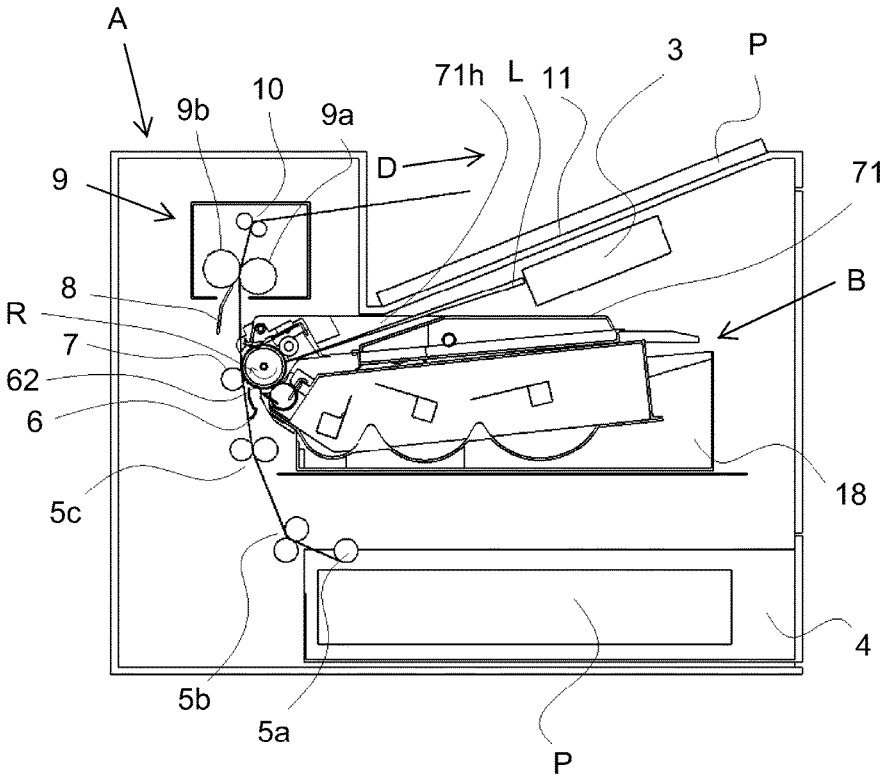
FIG. 2 is a sectional view of an image forming apparatus in which the cartridge in First Embodiment is mounted.
Figure 3:
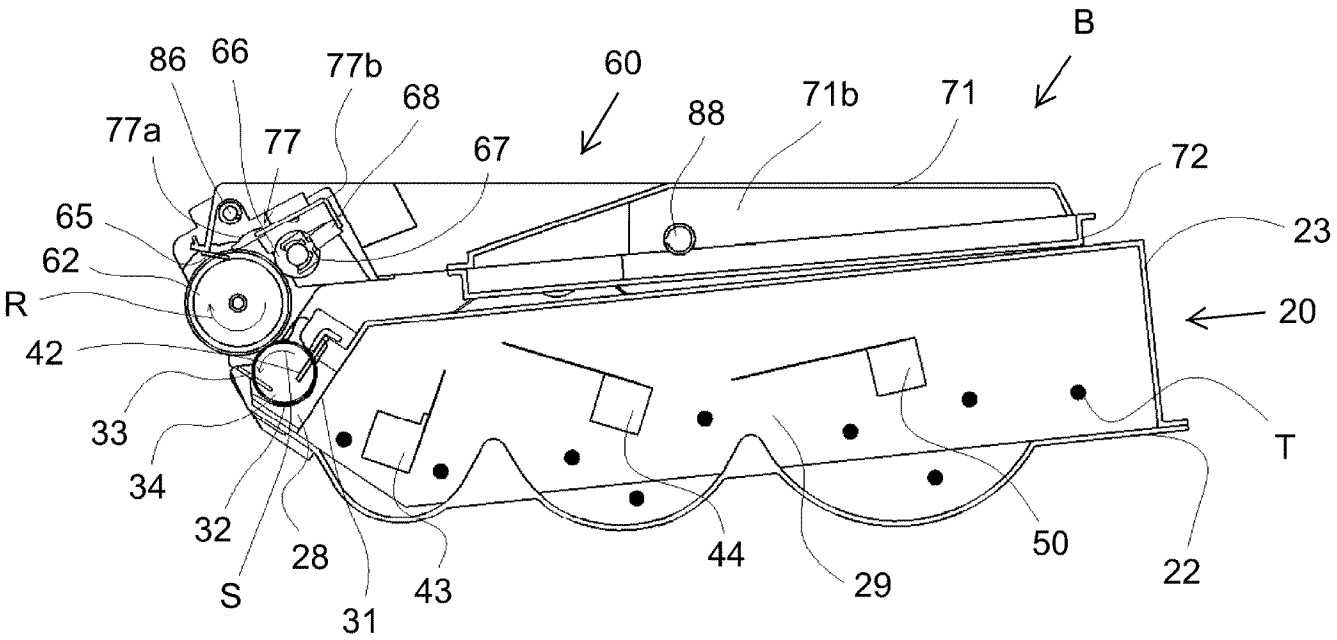
FIG. 3 is a sectional view of the cartridge in First Embodiment.

FIG. 2 is a sectional view of an image forming apparatus of an electrophotographic type in which a process cartridge according to this embodiment of the present invention is mountable to an image forming apparatus main assembly, and FIG. 3 is a sectional view of the process cartridge. Here, the process cartridge (hereinafter referred to as a cartridge B) is a cartridge which includes at least an image bearing member such as a photosensitive drum and which integrally includes the image bearing member and a process means actable on the image bearing member. Further, the image forming apparatus main assembly (hereinafter referred to as an apparatus main assembly A) is a portion obtained by excluding the cartridge B from the image forming apparatus. Such a cartridge B is replaced by (demountably) mounted in the apparatus main assembly A.

The image forming apparatus shown in FIG. 2 is a laser beam printer using electrophotography in which the cartridge B is detachably mountable to the apparatus main assembly A. In the following description, a rotational axis direction of the photosensitive drum is a longitudinal direction. Further, with respect to the longitudinal direction, a side in which the photosensitive drum receives a driving force from the apparatus main assembly A is a driving side, and an opposite side thereof is a non-driving side. A general structure and an image forming process will be described using FIGS. 2 and 3.

1) General Structure

When the cartridge B is mounted in the apparatus main assembly A, an exposure device (laser scanner unit) 3 for forming a latent image on the photosensitive drum (hereinafter referred to as a drum) 62 is provided. Further, below the cartridge B, a sheet (feeding) tray 4 in which a recording material (hereinafter referred to as a sheet material) P to be subjected to image formation is accommodated is provided.

Further, in the apparatus main assembly A, along a feeding direction D of the sheet material P, a pick-up roller 5*a*, a feeding roller pair 5*b*, a conveying roller pair 5*c*, a transfer guide 6, a transfer roller 7, a feeding guide 8, a fixing device 9, a discharging roller pair 10, a discharge tray 11 and the like are successively provided. The fixing device 9 is constituted by a heating roller 9*a* and a pressing roller 9*b*.

2) Image Forming Process

An outline of an image forming process will be described. On the basis of a print start signal, the drum 62 is rotationally driven at a predetermined peripheral speed (process speed) in an arrow R direction. Further, a charging roller 66 to which a bias voltage is applied contacts an outer peripheral surface of the drum 62 and electrically charges the outer peripheral surface of the drum 62 uniformly.

The exposure device 3 outputs laser light L depending on image information. The laser light L passes through a laser opening 71*h* provided in a cleaning frame 71, so that the outer peripheral surface of the drum 62 is subjected to scanning exposure. As a result, on the outer peripheral surface of the drum 62, an electrostatic latent image depending on the image information is formed.

On the other hand, in a developing unit 20 as a developing device, a toner T in a toner chamber 29 is stirred and fed by rotation of a first feeding member 43, a second feeding member 44 and a third feeding member 50, and thus is sent to a toner supplying chamber 28. The toner T is carried by a magnetic force of a magnet roller 34 (fixed magnet) on a surface of a developing roller 32 as a developer rotatable member.

The toner T is regulated in layer thickness on the peripheral surface of the developing roller 32 by a developing blade 42 as a blade member while being triboelectrically charged. The toner T develops the electrostatic latent image, and visualizes the electrostatic latent image into a toner image.

As shown in FIG. 2, in synchronism with output timing of the laser light L, by the pick-up roller 5*a*, the feeding roller pair 5*b* and the conveying roller pair 5*c*, the sheet material P accommodated in the sheet tray 4 provided at a lower portion of the apparatus main assembly A is fed from the sheet tray 4. Then, the sheet material P is fed to a transfer position between the drum 62 and the transfer roller 7 via the transfer guide 6. In this transfer position, the toner image is successively transferred from the drum 62 onto the sheet material P.

The sheet material P on which the toner image is transferred is separated from the drum 62 and then is fed to the fixing device 9 along the conveying guide 8. Then, the sheet material P passes through a nip between the heating roller 9*a* and the pressing roller 9*b* which constitute the fixing device 9. At this nip, a pressure and heat-fixing process is effected, so that the toner image is fixed on the sheet material P. The sheet material P on which the toner image is fixed is fed to the discharging roller pair 10 and then is discharged onto the discharge tray 11.

On the other hand, as shown in FIG. 3, the drum 62 after the toner image transfer is, after a residual toner on the outer peripheral surface of the drum 62 is removed by a cleaning blade 77, used again in the image forming process. The residual toner removed from the drum 62 is stored in a residual toner chamber 71*b* of a cleaning unit 60.

In the above, the charging roller 66, the developing roller 32, the transfer blade 7 and the cleaning blade 77 are process means actable on the drum 62.

(Mounting and Demounting of Cartridge)

Figure 5:
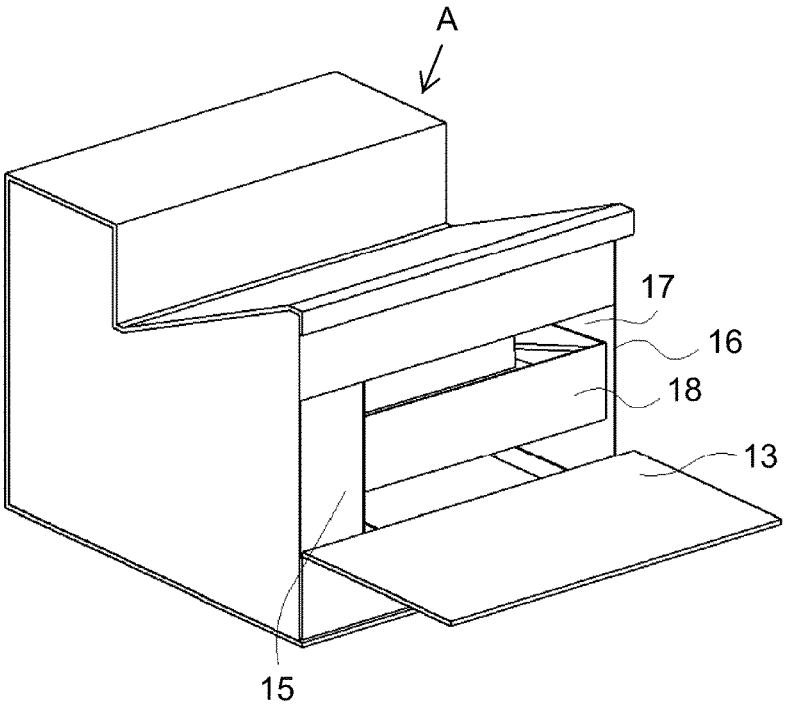
FIG. 5 is a perspective view of an image forming apparatus main assembly in a state in which an openable door of the image forming apparatus in which the cartridge in First Embodiment is mounted is open.
Figure 6:
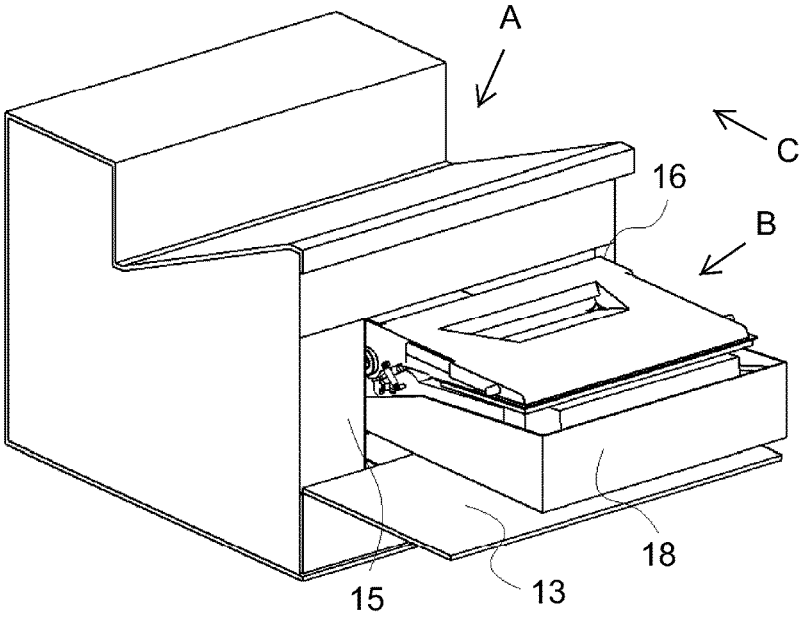
FIG. 6 is a perspective view of the image forming apparatus main assembly in a state in which the openable door of the image forming apparatus in which the cartridge in First Embodiment is mounted is opened and then a tray is pulled out.
Figure 7:
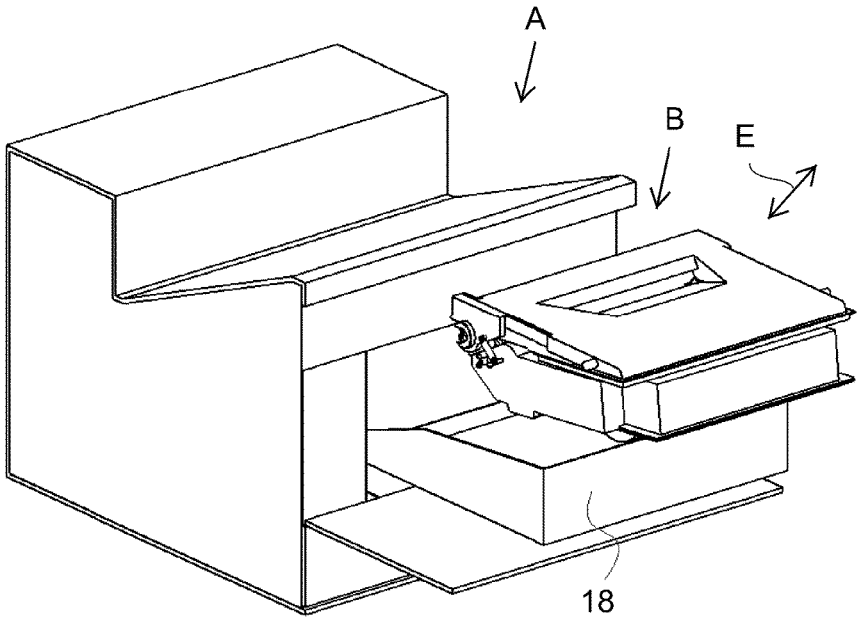
FIG. 7 is a perspective view of the image forming apparatus main assembly and the process cartridge when the cartridge is mounted in and demounted from the tray in the state in which the openable door of the image forming apparatus in which the cartridge in First Embodiment is mounted is opened and then the tray is pulled out.

Next, mounting and demounting of the cartridge B will be described using FIGS. 5 and 6. FIG. 5 is a perspective view of the apparatus main assembly A for which an openable door 13 is opened for permitting mounting and demounting of the cartridge B. FIG. 6 is a perspective view of the apparatus main assembly A and the cartridge B in a state in which the openable door 13 is opened for permitting the mounting and demounting of the cartridge B and then a tray 18 is pulled out. FIG. 7 is a perspective view of the apparatus main assembly A and the cartridge B when the cartridge B is mounted and demounted in the state in which the openable door 13 is opened and then the tray 18 is pulled out. In FIG. 7, the cartridge B is mountable in and demountable from the tray 18 along a mounting and demounting direction E.

As shown in FIG. 5, to the apparatus main assembly A, the openable door 13 is rotatably attached, and when the openable door 13 is opened, a cartridge inserting opening 17 is exposed. In the cartridge inserting opening 17, the tray 18 for mounting the cartridge B in the apparatus main assembly A is provided. When the tray 18 is pulled out to a predetermined position, the cartridge B can be mounted and demounted. The cartridge B is mounted in the apparatus main assembly A along a guide rail (not shown) in an arrow C direction (FIG. 6) in a state in which the cartridge B is placed on the tray 18.

Figure 8:
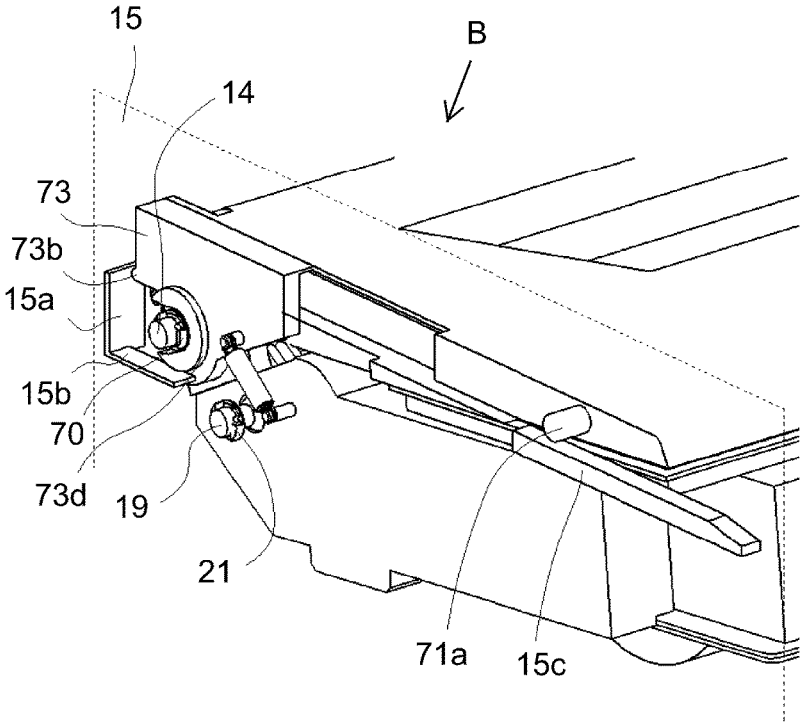
FIG. 8 is a perspective view showing a driving side positioning portion between the cartridge and the image forming apparatus main assembly in a state in which the cartridge is First Embodiment is mounted in the image forming apparatus main assembly.
Figure 9:
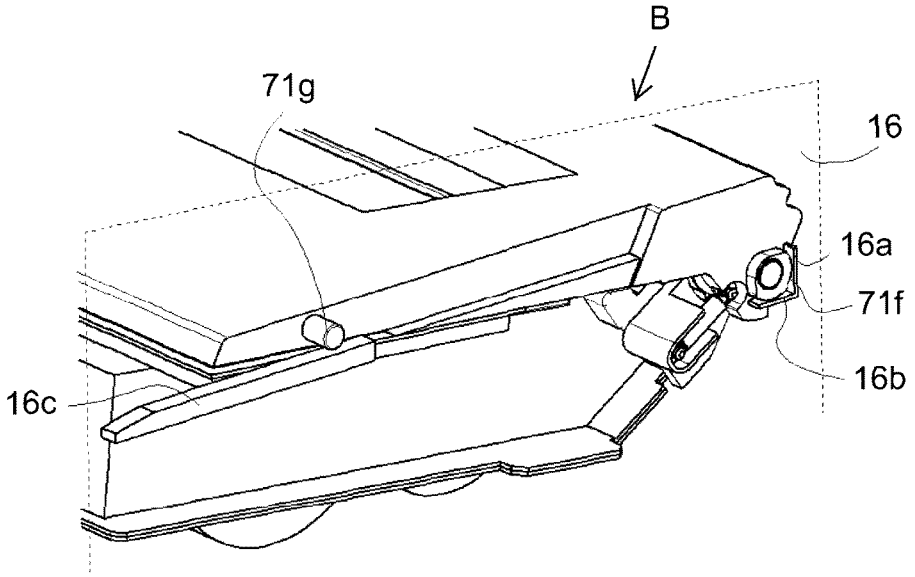
FIG. 9 is a perspective view showing a non-driving side positioning portion between the cartridge and the image forming apparatus main assembly in the state in which the cartridge in First Embodiment is mounted in the image forming apparatus main assembly.

In FIG. 8, a first driving shaft 14 and a second driving shaft 19 for transmitting a driving force to a first coupling 70 and a second coupling 21, respectively, are provided. The first driving shaft 14 and the second driving shaft 19 are driven by a motor (not shown) for the apparatus main assembly A. As a result, the drum 62 connected with the first coupling 70 receives the driving force from the apparatus main assembly A and is rotated. The developing roller 32 is rotated by transmission of the driving force from the second coupling 21. Further, to the charging roller 66 and the developing roller 32, electric power is supplied by an electric power supplying portion (not shown) of the apparatus main assembly A.

(Support of Cartridge)

As shown in FIG. 5, the apparatus main assembly A is provided with a driving(-side) side plate 15 and the non-driving(-side) side plate 16 for supporting the cartridge B. The driving(-side) side plate 15 is provided with a driving-side first supporting portion 15*a*, a driving-side second supporting portion 15*b* and a rotation supporting portion for the cartridge B. The non-driving(-side) side plate 16 is provided with a non-driving(-side) first supporting portion 16*a*, a non-driving(-side) second supporting portion 16*b* and a rotation supporting portion 16*c* for the cartridge B.

On the other hand, as portions-to-be-supported of the cartridge B, a portion-to-be-supported 73*b* and a portion-to-be-supported 73*d* of a drum bearing 73, and a driving-side boss 71*a*, a non-driving-side projection 71*f* and a non-driving side boss 71*g* of the cleaning frame 71 are provided. The portion-to-be-supported 73*b* is supported by the driving side-first supporting portion 15*a*, the portion-to-be-supported 73*d* is supported by the driving side-second supporting portion 15*b*, and the driving side boss 71*a* is supported by the rotation supporting portion 15*c*. Further, the non-driving-side projection 71*f* is supported by the non-driving-side first supporting portion 16*a* and the non-driving-side second supporting portion 16*b*, and the non-driving-side boss 71*g* is supported by the rotation supporting portion 16*c*, so that the cartridge B is positioned inside the apparatus main assembly A.

(General Structure of Cartridge)

Figure 10:
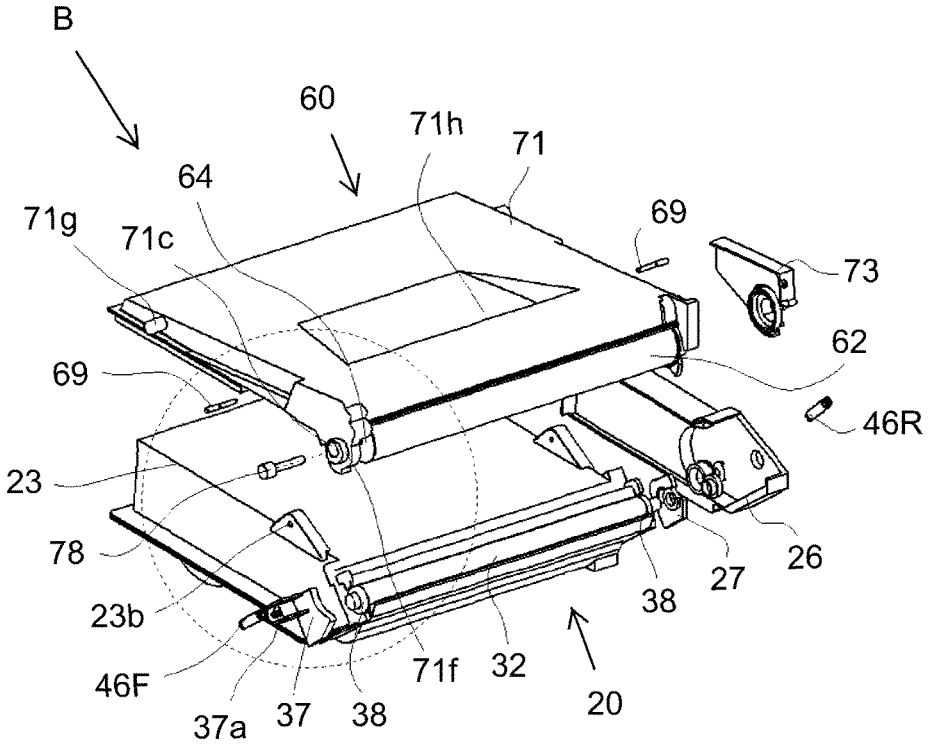
FIGS. 10 to 13 are exploded perspective views each showing the cartridge in First Embodiment.
Figure 11:
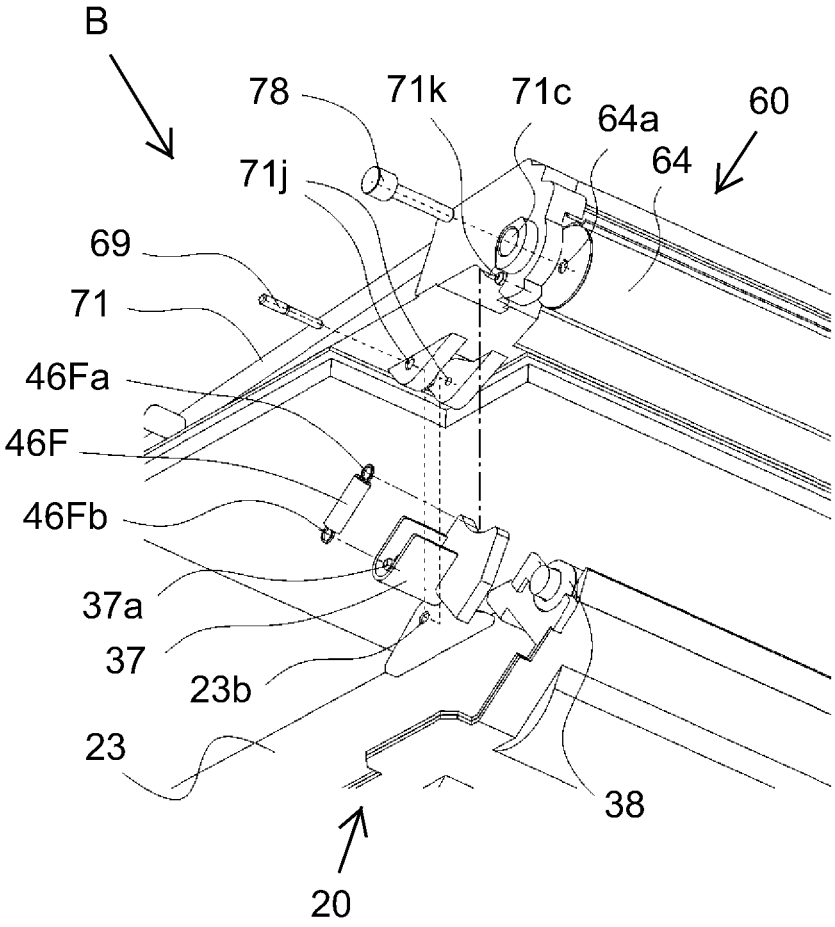
Figure 13:
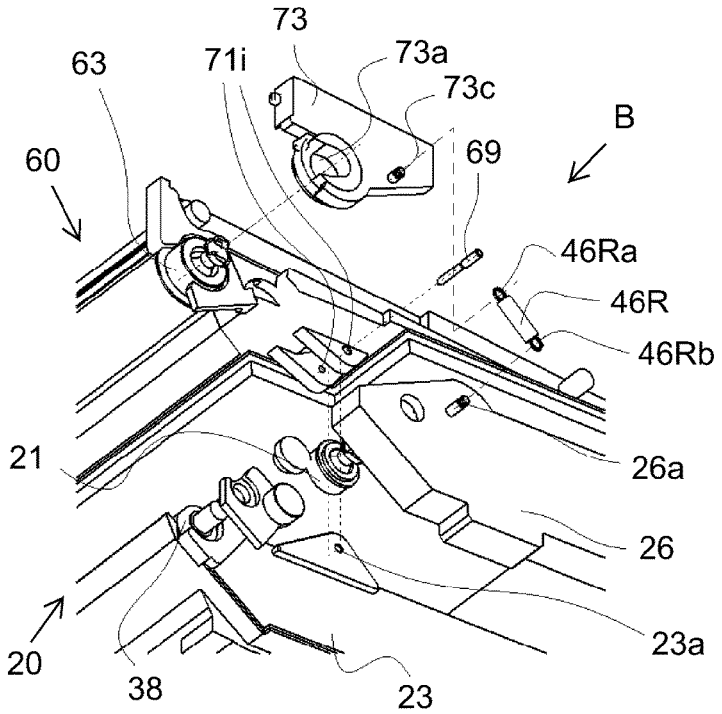
Figure 14:
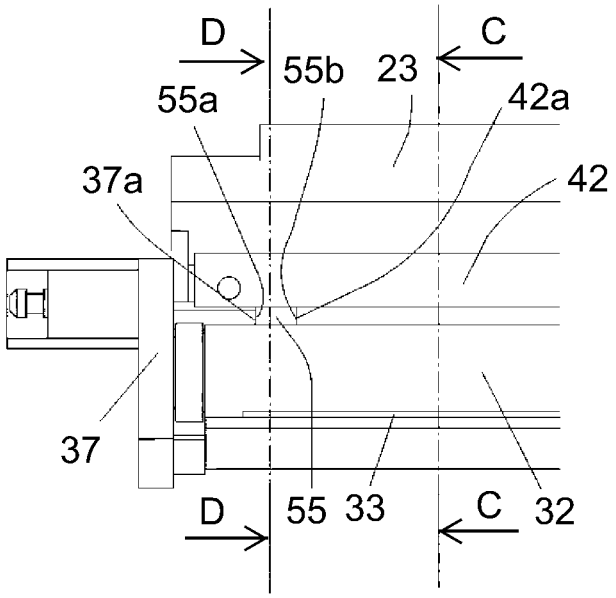
In FIG. 14, (a) and (b) are detailed views each showing a structure of a periphery of a developing roller of the cartridge in First Embodiment.
Figure 14:
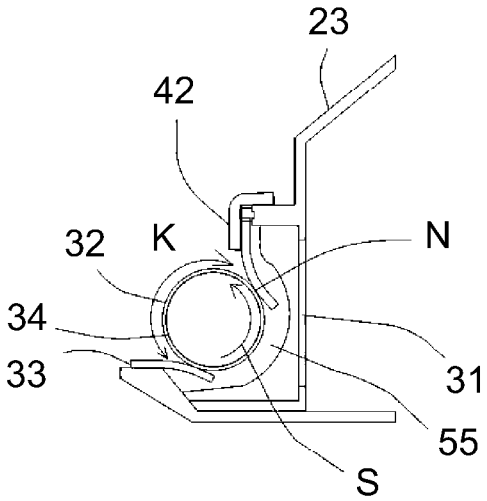

A general structure of the cartridge B will be described using FIGS. 3, 4 and 10 to 14. FIG. 3 is a sectional view of the cartridge B, and FIGS. 10 to 13 are perspective views for illustrating a structure of the cartridge B, and (a) and (b) of FIG. 14 are partial sectional views of the cartridge B. FIGS. 11 and 13 are partly enlarged perspective views showing dotted circuit portions in FIGS. 10 and 12, respectively, as seen from different angles. In FIG. 14, (a) is a sectional view showing a structure of the developing roller 32 and a periphery thereof, and (b) is a sectional view of C-C cross section of (a) of FIG. 14. In this embodiment, description will be made by omitting screws during connection of respective components.

The cartridge B includes the cleaning unit 60 and the developing unit 20. As shown in FIG. 10, the cleaning unit 60 and the developing unit 20 are rotatably connected with each other by connecting pins 69.

The cleaning unit 60 includes the drum 62, a drum bearing 73 and a drum shaft 78 which rotatably support the drum 62, the charging roller 66, the cleaning member 77, the cleaning frame 71 supporting these members, and a cap member 72 fixed to the cleaning frame 71.

The drum 62 is rotationally driven in the arrow R direction in FIG. 3 depending on an image forming operation by receiving a driving force from a main assembly driving motor (not shown) as a driving source. As shown in FIG. 13, in the driving side, the drum 62 is rotatably supported in a manner that a driving-side drum flange 63 provided in the driving side is rotatably supported by a hole 73*a* provided in the drum frame 73. On the other hand, as shown in FIG. 11, in the non-driving side, the drum shaft 78 press-fitted in a hole 71*c* provided in the cleaning frame 71 rotatably supports a hole 64*c* provided in a non-driving-side drum flange 64. In the cleaning unit 60, each of the charging roller 66 and the cleaning member 77 is disposed in contact with the outer peripheral surface of the photosensitive drum 62.

The charging roller 66 is rotatably mounted in the cleaning unit 60 via a charging roller bearing 67 in each of end portion sides with respect to a longitudinal direction (substantially parallel to a rotational axis direction of the drum 62) of the cleaning frame 71. The charging roller 66 is press-contacted to the drum 62 by pressing the charging roller bearing 67 toward the drum 62 by an urging member 68. The charging roller 66 is rotated by the rotation of the drum 62.

The cleaning member 77 includes a rubber blade 77*a* which is a blade-shaped elastic member formed with a rubber as an elastic member, and a supporting member 77*b* for supporting the rubber blade 77*a*. The rubber blade 77*a* counter directionally contacts the drum 62 with respect to a rotational direction of the drum 62. That is, the rubber blade 77*a* contacts the drum 62 so that a free end portion thereof extends toward an upstream side with respect to the rotational direction of the drum 62.

Further, as shown in FIG. 3, a receptor sheet 65 for preventing leakage-out of a residual (waste) toner from the cleaning frame 71 is provided on the cleaning frame 71 so as to contact the drum 62.

Figure 4:
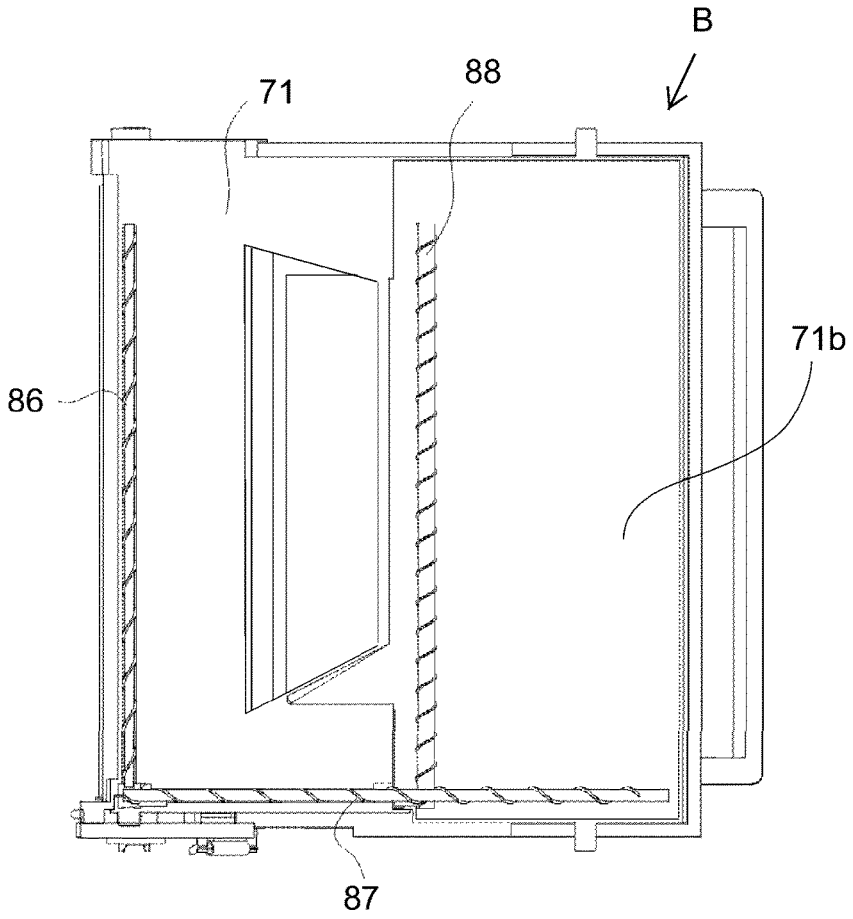
In FIG. 4, (a) and (b) are sectional views each showing an inside of a cleaning frame of the cartridge in First Embodiment.
Figure 4:
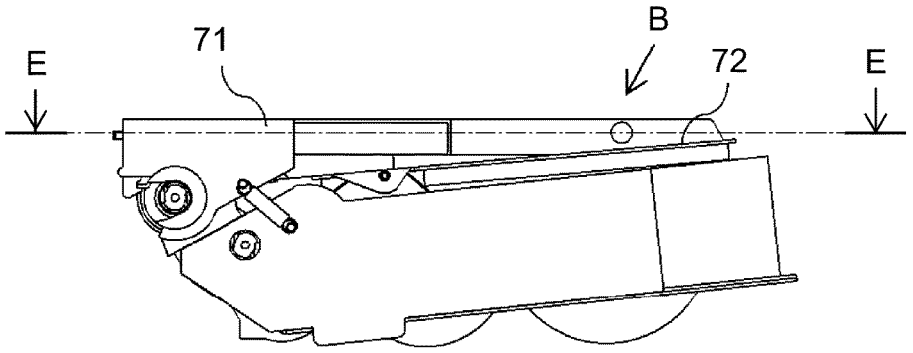

As shown in FIGS. 3 and 4, the residual toner removed from the surface of the drum 62 by the cleaning member 77 is fed by a first screw 86, a second screw 87 and a third screw 88 which are used as a residual toner feeding member. Then, the residual toner is accumulated in a residual toner chamber 71*b* formed by the cleaning frame 71 and the cap member 72.

Specifically, the first screw 86 is rotated by a gear (not shown) by transmission of a driving force from a coupling 21 shown in FIG. 13 thereto. The second screw 87 and the third screw 88 are rotated by receiving the driving force from the first screw 86 and the second screw 87, respectively. The first screw 86 is disposed in the neighborhood of the drum 62, the second screw 87 is disposed at an end portion of the cleaning frame 71 with respect to the longitudinal direction, and the third screw 88 is disposed in the residual toner chamber 71*b*.

Here, rotation shafts (axes) of the first screw 86 and the third screw 88 are parallel to a rotation shaft (axis) of the drum 62, and a rotation shaft (axis) of the second screw 87 is perpendicular to the rotation shaft of the drum 62. As a result, the residual toner removed from the surface of the drum 62 is successively fed to the residual toner chamber 71*b* by the first screw 86, the second screw 87 and the third screw 88.

On the other hand, the developing unit 20 includes the developing roller 32 rotationally driven in an arrow S direction in FIG. 3, the developing blade 42, a driving-side developing side plate 26, a leakage-preventing sheet 33, a developing device frame 23, a bottom member 22 fixed to the developing device frame 23, and the like.

The developing roller 32 is mounted to the developing device frame 23 rotatably about bearing members 27, 37 provided at end portions of the developing device frame 23. The developing roller 32 is rotationally driven in the arrow S direction in FIG. 3. Inside the developing roller 32, a magnet roller 34 is provided. In the developing unit 20, the developing blade 42 for regulating a toner layer on the developing roller 32 is fixed to the developing device frame 23. As a result, a layer thickness of the toner carried on the surface of the developing roller 23 by a magnetic force of the magnet roller 34 is regulated at the contact portion between the developing blade 42 and the developing roller 32, and the toner is carried on the surface of the developing roller 32 in a region K shown in (b) of FIG. 14.

Further, as shown in FIG. 3, the leakage-preventing sheet 33 for preventing leakage of the toner from the developing unit 20 is provided on the bottom member 22 in contact with the developing roller 32. The leakage-preventing sheet 33 is provided downstream of the region K with respect to the rotational direction of the developing roller 32 and contacts the developing roller 32, so that the leakage-preventing sheet 33 prevents the leakage of the toner from the downstream side with respect to the developing roller rotational direction.

Further, in the toner chamber 29 formed by the developing device frame 23 and the bottom member 22 which constitute a casing, the first to third feeding members 43, 44 and 50 are provided. The first to third feeding members 43, 44 and 50 not only stir the toner accommodated in the toner chamber 29 but also feed the toner to the toner supplying chamber 28 through an opening 31.

Figure 12:
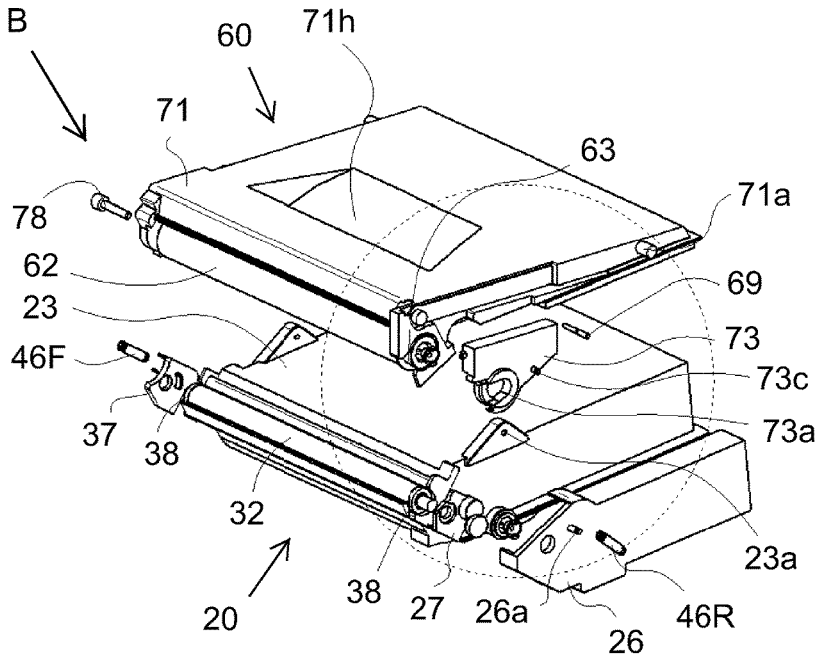

The cartridge B is constituted by combining the cleaning unit 60 and the developing unit 20 as shown in FIGS. 10 and 12.

Specifically, a developing-first supporting hole 23*a* and a developing-second supporting hole 23*b* are provided in members formed on the developing device frame 23 at longitudinal end portions of the developing unit 20. Further, at longitudinal end portions of the cleaning unit 60, first hanging holes 71*i* and second hanging holes 71*j* are provided in members formed on the cleaning frame 71. By engagement of the connecting pin 69 press-fitted and fixed in the first hanging holes 71*i* and the second hanging holes 71*j* with the first supporting hole 23*a* and the second supporting hole 23*b*, the cleaning unit 60 and the developing unit 20 are rotatably connected with each other.

Further, a first hole 46Ra of a driving-side-urging member 46R is hooked on a boss 73*c* of the drum bearing 73, and a second hole 46Rb of the driving-side urging member 46R is hooked on a boss 26*a* of the driving-side-developing side member 26. Further, a first hole 46Fa of a non-driving-side urging member 46F is hooked on a boss 71*k* of the cleaning frame 71, and a second hole 46Fb of the non-driving-side urging member 46F is hooked on a boss 37*a* of the bearing member 37.

In this embodiment, each of the driving-side urging member 46R and the non-driving-side urging member 46F is formed with a tension spring. The developing unit 20 is urged toward the cleaning unit 60 by an urging force of these springs, so that the developing roller 32 is constituted so as to be pressed toward the drum 62 with reliability. Then, by contact with the drum 62 of the gap holding members 38 provided at the end portions of the developing roller 32, the developing roller 32 is held with a predetermined minute gap with the drum 62 in a region between the gap holding members 38.

(Toner Seal Constitution at Periphery of Developing Blade)

Next, a toner seal(ing) constitution at a periphery of the developing blade 42 will be described using FIGS. 1A, 1B and 14 to 17. First, a general structure will be described. In this embodiment, with respect to a rotational axis direction of the developing roller 32 (rotatable member), a blade seal member (first seal member) for sealing the developer in contact with the blade member is provided. Further, an end portion seal member (second seal member) for sealing the developer in contact with not only each of end portions of the blade with respect to the rotational axis direction of the developing roller 32 but also the blade seal member.

1) Blade Seal Member 56

Figure 1A:
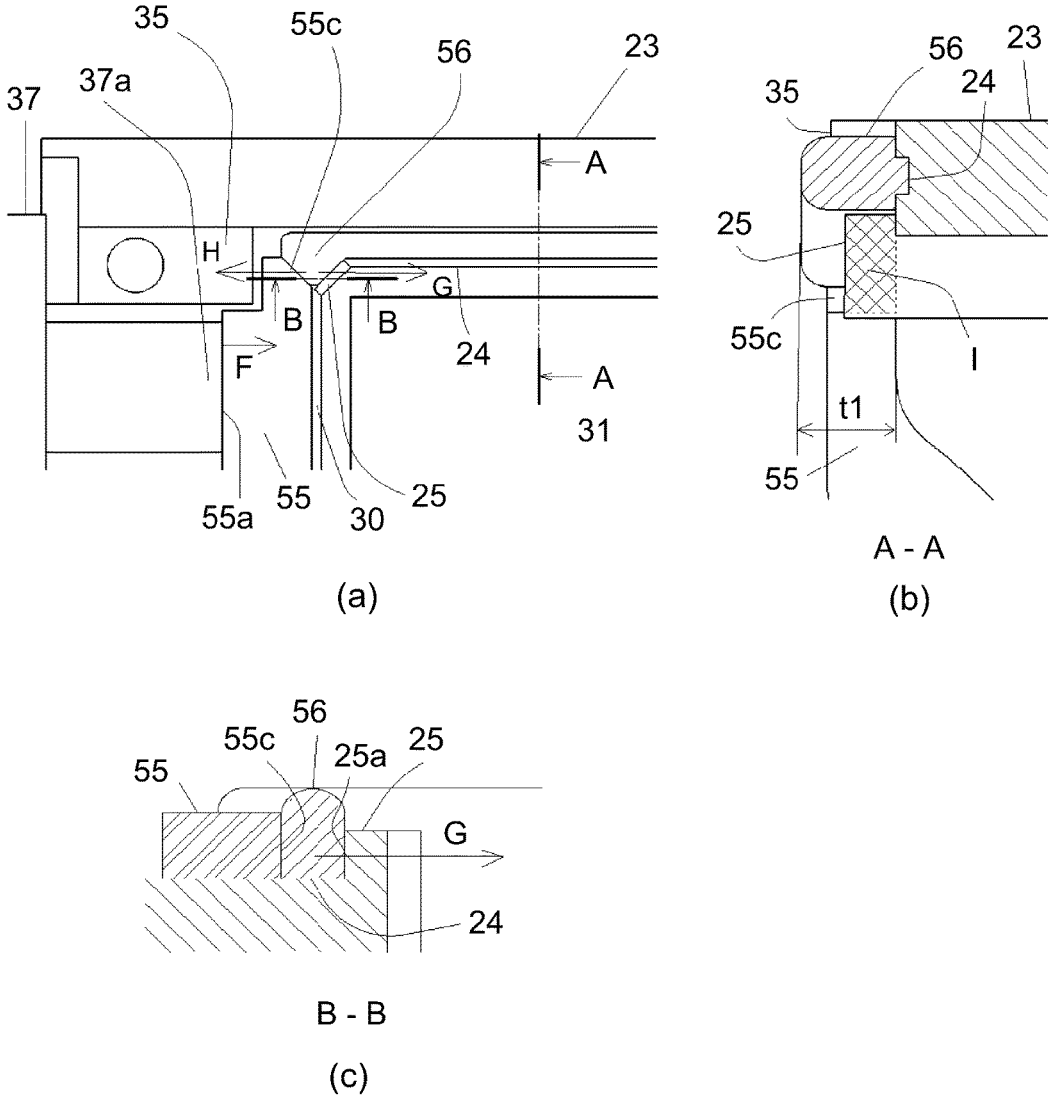
In FIG. 1A, (a) to (c) are exploded views each showing an end portion seal member and the neighborhood thereof in a cartridge according to First Embodiment of the present invention.

As shown in FIG. 1A, for example, on the bearing surface 24 provided on the developing device frame 23, a liquid resin material such as a melted hot-melt resin material is applied and formed. As regards the blade seal member 56, after the formation, the developing blade 42 is mounted, and the blade seal member 56 is disposed so as to seal the toner in contact with the developing blade 42 and the developing device frame 23. That is, the blade seal member 56 is disposed so as to be sandwiched between the developing blade 42 and the developing device frame 23, so that as a sealing extending in the rotational axis direction of the developing roller 32, i.e., a longitudinal direction of the developing blade 42, the blade seal member 56 suppresses the leakage of the toner from between the developing blade 42 and the developing device frame 23.

In this embodiment, as the blade seal member 56, the hot-melt resin material was described as an example. However, the blade seal member 56 is not limited thereto, but may also be an elastic member formed of an elastomer resin material or an urethane foam. In this embodiment, as the blade seal member 56, for example, an elastic member formed of a felt, an elastomer, a rubber or an urethane foam can be used, so that a similar effect can be obtained.

2) End Portion Seal Member 55

FIG. 1A shows a structure at a periphery of the end portion seal member 55. In FIG. 1A, (a) shows a state when the developing blade 42 and the developing roller 32 are removed from a structure shown in FIG. 14.

The developing device frame 23 is provided with a bearing surface 30 to which the end portion seal member 55 is to be bonded, and the end portion seal member 55 is bonded to the bearing surface 30.

Thus, as shown in (a) of FIG. 14, at each of the end portions of the developing roller 23 with respect to the rotational axis direction of the developing roller 23, the end portion seal member 55 formed of a felt or the like is provided on the developing device frame 23. When the developing roller 32 is rotatably supported by the developing device frame 23 via the bearing member 37, the end portion seal member 55 is sandwiched between the developing device frame 23 and the developing roller 32. As a result, at each of the end portions of the developing roller 32 with respect to the rotational axis direction, the leakage of the toner from between the developing roller 32 and the developing device frame 23 is prevented.

Figure 15:
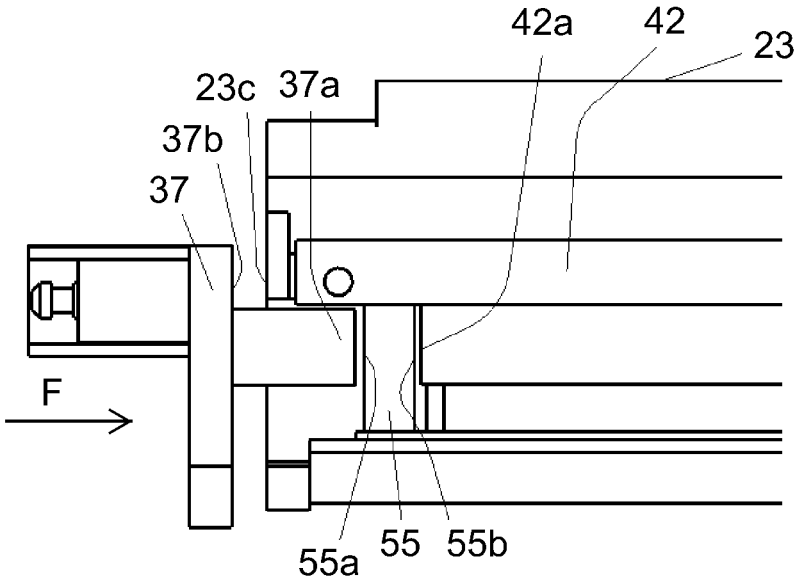
In FIG. 15, (a) and (b) are exploded views each showing the structure of the periphery of the developing roller of the cartridge in First Embodiment.
Figure 15:
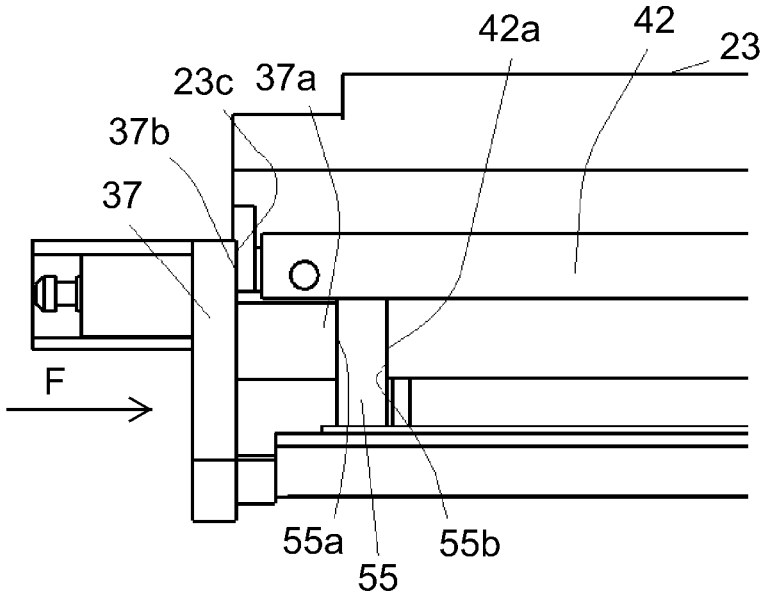

FIG. 15 shows a state before the developing roller 32 is mounted to the developing device frame 23. As shown in (a) of FIG. 15, the end portion seal member 55 is bonded at a position with a minute gap with an opposing end surface 42*a* of the developing blade 42. Then, the developing roller 32 (not shown in FIG. 15) is disposed at a predetermined position, and the bearing member 37 is inserted in an F direction from an end portion toward a central portion of the developing roller 32. The bearing member 37 is inserted until a longitudinal positioning surface 37*b* of the bearing member 37 abuts against a developing device frame end surface 23*c*.

At this time, before the longitudinal positioning surface 37*b* of the bearing member 37 abuts against the developing device frame end surface 23*c*, an urging portion 37*a* formed on the bearing member 37 contacts an end portion (surface) 55*a* of the end portion seal member 55. When the bearing member 37 is further inserted, the end portion 55*a* of the end portion seal member 55 receives an urging force in the F direction from the urging portion 37*a*, so that the end portion seal member 55 is urged toward the developing blade 42.

In FIG. 15, (b) shows a state after the bearing member 37 is inserted in the F direction. When the longitudinal positioning surface 37*b* of the driving member 37 is inserted until the positioning surface 37*b* abuts against the developing device frame end surface 23*c*, an end portion (surface) 55*b* of the end portion seal member 55 contacts the end surface 42*a* of the developing blade 42. As a result, leakage of the toner from a boundary between the developing blade 42 and the end portion seal member 55 is prevented.

3) Detailed Structure at Boundary Between End Portion Seal Member 55 and Blade Seal Member 56

As shown in FIG. 1A, in this embodiment, the end portion seal member 55 has an inclined surface (first surface) 55*c*, constituting a contact surface with the blade seal member 56, which extends so as to cross the rotational axis direction of the developing roller 32 and which opposes the blade seal member 56. On the other hand, the developing device frame 23 includes a wall 25 having a surface 25*a* (second surface), crossing the inclined surface 55*c* of the end portion seal member 55 and the rotational axis direction of the developing roller 32, in the neighborhood of the inclined surface 55*c* of the end portion seal member 55 in order to regulate a position of the blade seal member 56. As shown in (a) of FIG. 1A, each of the inclined surface 55*c* and the surface 25*a* is inclined with respect to the rotational axis direction of the developing roller 32.

With reference to (b) of FIG. 1A, a positional relationship between the surface 55*c* of the end portion seal member 55 and the wall 25 will be described. In FIG. 1A, (b) is a sectional view of a bonding portion of the end portion seal member 55 in a cross-section cut along A-A direction of (a) of FIG. 1A. As described above, on the bearing surface 24, the wall 25 is provided. The wall 25 includes a region I overlapping with the surface 55*c* of the end portion seal member 55 with respect to the rotational axis direction of the developing roller 32. That is, at a position opposing the surface 55*c* of the end portion seal member 55, the wall 25, i.e., the surface 25*a* is provided. In FIG. 1A, (c) is a sectional view of the bonding portion of the end portion seal member 55 in a cross-section cut along B-B direction, of (a) of FIG. 1A, extending in the rotational axis direction of the developing roller 32. As shown in (c) of FIG. 1A, with respect to the rotational axis direction of the developing roller 32, the end portion seal member 55, the blade seal member 56 and the wall 25 (surface 25*a*) are successively arranged. In this embodiment in which the blade seal member 56 is formed by applying the hot-melt resin material onto the bearing surface 24, by the wall 25, it is possible to prevent an overflow of the hot-melt resin material in an arrow G direction when the hot-melt resin materials runs over the bearing surface 24 during injection of the hot-melt resin material.

Further, the hot-melt resin material is accumulated between the surface 55*c* of the end portion seal member 55 and the surface 25*a* of the wall 25, and the blade seal member 56 is formed, and therefore, the surface 55*c* of the end portion seal member 55 hermetically contact each other with no gap therebetween. As a result, a toner sealing force at a boundary between the end portion seal member 55 and the blade seal member 56 can be improved. As shown in (a) of FIG. 1A, a constitution in which an end portion of the blade seal member 56 with respect to the rotational axis direction of the developing roller 32 contacts the surface 55*c* is employed.

Figure 16:
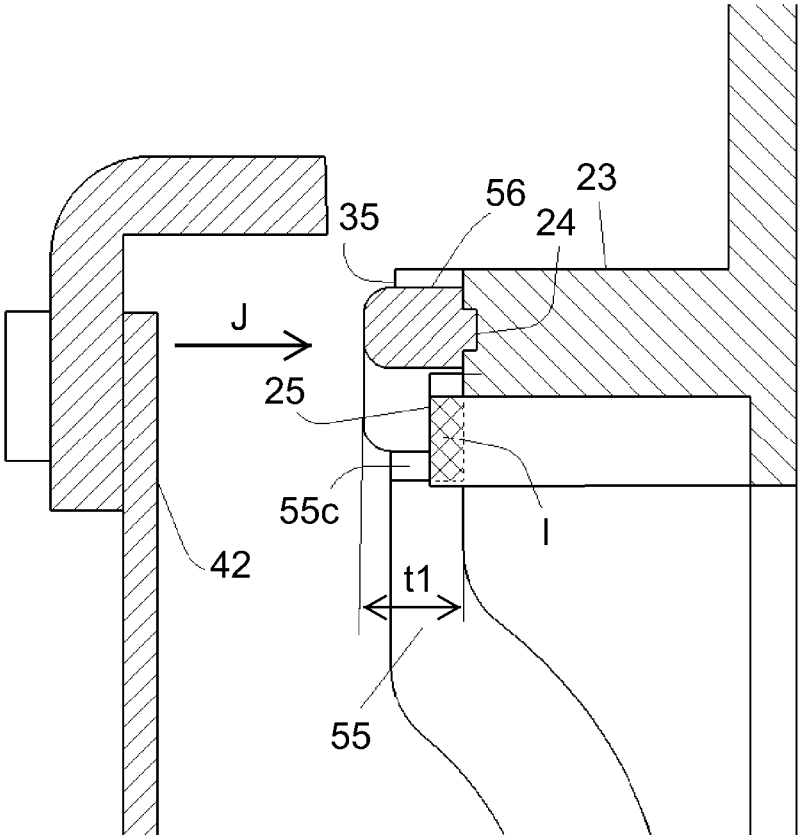
FIG. 16 is a sectional view, of A-A cross section of FIG. 1A, showing the end portion seal member and the neighborhood thereof, in the cartridge in First Embodiment.
Figure 17:
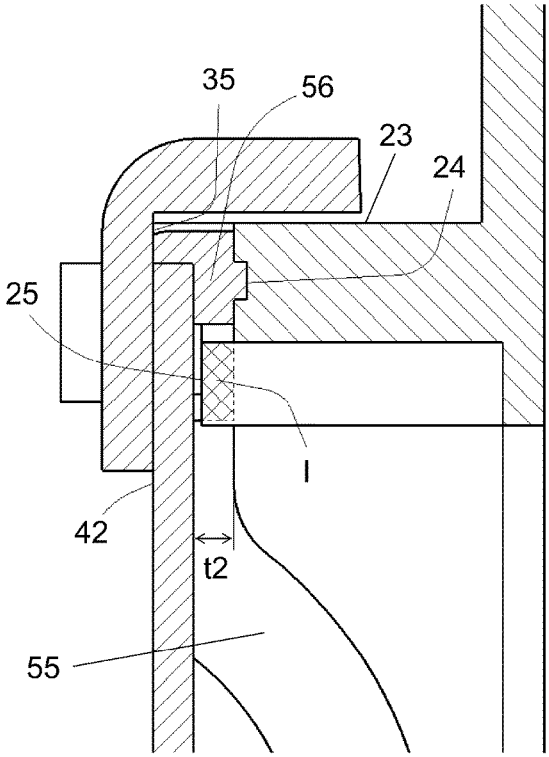
FIG. 17 is a sectional view, of the A-A cross section of FIG. 1A, showing the end portion seal member and the neighborhood thereof, in the cartridge in First Embodiment.

When the developing blade 42 is assembled with the developing device frame 23, as shown in FIG. 16, the developing blade 42 is assembled with the developing device frame 23 so that the developing blade 42 is moved in an arrow J direction crossing the rotational axis direction of the developing roller 32. A state after the developing blade 42 is assembled is shown in FIG. 17. As shown in FIG. 17, the developing blade 42 is assembled with the developing device frame 23, so that the blade seal member 56 is compressed from a thickness t1 shown in FIG. 16 to a thickness t2 shown in FIG. 17. Further, as shown in FIG. 17, the wall 25 projects toward the developing blade 42 relative to the bearing surface 24, but does not contact the developing blade 42.

At this time, the compressed blade seal member 56 is prevented by the wall 25 from extending in the arrow G direction in (a) of FIG. 1A, and therefore extends in an arrow H direction in (a) of FIG. 1A. At this time, the extended blade seal member 56 is received by the surface 55*c* of the end portion seal member 55, and therefore the blade seal member 56 hermetically contacts the surface 55*c* of the end portion seal member 55 strongly. As a result, the toner sealing force at the boundary between the end portion seal member 55 and the blade seal member 56 can be further improved.

Further, as shown in (a) of FIG. 1A, the wall 25 is provided at the position opposing the surface 55*c* of the end portion seal member 55 with respect to the rotational axis direction of the developing roller 32. For this reason, when the end portion 55*a* of the end portion seal member 55 receives the urging force in the arrow F direction from the urging portion 37*a*, the blade seal member 56 is sandwiched by the surface 55*c* of the end portion seal member 55 and the wall 25. As a result, the end portion seal member 55 hermetically contacts the blade seal member 56 further strongly, so that the toner sealing force can be further improved.

Figure 1B:
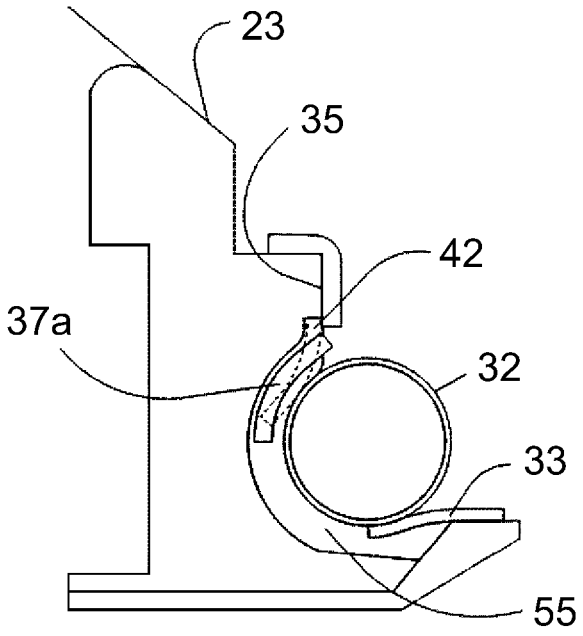
FIG. 1B is a sectional view, of D-D cross section of FIG. 14, showing an end portion seal member bonding portion of the cartridge according to First Embodiment.

FIG. 1B is a sectional view of D-D cross-section of FIG. 14, in which the end portion seal member 55 is included. As shown in FIG. 1B, a region in which the urging portion 37*a* urges the end portion seal member 55 is provided in a region overlapping with the developing blade 42 with respect to the rotational axis direction of the developing roller 32. As a result, the surface 55*b* of the end portion seal member 55 is contacted to the end surface 42*a* of the developing blade 42 with reliability.

Further, as shown in FIG. 1A, by employing the above-described constitution, the urging portion 37*a* can urge a region close to the inclined surface 55*c* of the end portion seal member while avoiding a mounting bearing surface 35 of the developing blade 42. As a result, the end portion seal member 55 hermetically contacts the blade seal member 56 further strongly, so that the toner sealing force can be further improved.

As described above, according to this embodiment, the first seal member and the second seal member are hermetically contacted to each other further strongly at the boundary therebetween, so that the toner sealing force can be improved.

Second Embodiment

Second Embodiment of the present invention will be described with reference to FIG. 18. In this embodiment, a portion different from first Embodiment described above will be specifically described. Unless otherwise specified, materials, shapes and the like of constituent elements are the same as those in First Embodiment. The constituent elements are represented by the same reference numerals or symbols and will be omitted from detailed description.

Figure 18:
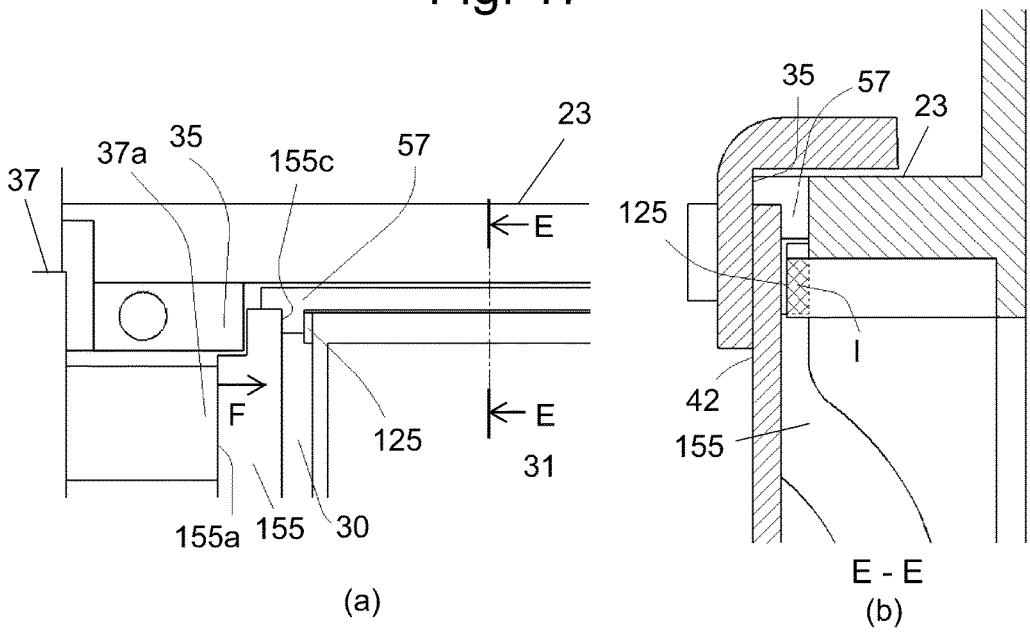
In FIG. 18, (a) and (b) are exploded views each showing a structure of an end portion seal member and the neighborhood thereof in a cartridge according to Second Embodiment.

As shown in (a) of FIG. 18, in this embodiment, a blade seal member 57 has a surface (first surface) 155*c*, constituting a contact surface with an end portion seal member 155, which extends so as to cross the rotational axis direction of the developing roller 32 and which opposes the end portion seal member 155. On the other hand, the developing device frame 23 includes a wall 125 having a surface (second surface), parallel to the inclined surface 155*c* of the end portion seal member 155 and the rotational axis direction of the developing roller 32, in the neighborhood of the surface 155*c* of the end portion seal member 155 in order to regulate a position of the blade seal member 57.

Next, with reference to (b) of FIG. 18, a positional relationship between the surface 155*c* of the end portion seal member 155 and the wall 125 will be described. In FIG. 18, (b) is a sectional view of a bonding portion of the end portion seal member 155 in E-E cross-section of (a) of FIG. 18. The surface 155*c* of the end portion seal member 155 includes a region I overlapping with the wall 125 provided on the developing device frame 23 with respect to the rotational axis direction of the developing roller 32. That is, at a position opposing the surface 155*c* of the end portion seal member 155, the wall 125 is provided.

Further, similarly as in First Embodiment, the end portion seal member 155 seals a boundary between the developing blade 42 and the end portion seal member 155 by being urged toward the developing blade 42 by the urging portion 37*a* provided on the bearing member 37. Further, as shown in (a) of FIG. 18, the wall 125 is provided at the position opposing the surface 155*c* of the end portion seal member 155 with respect to the rotational axis direction of the developing roller 32. For this reason, when the end portion 155*a* of the end portion seal member 155 receives the urging force in the arrow F direction from the urging portion 37*a*, the blade seal member 57 is sandwiched by the surface 155*c* of the end portion seal member 155 and the wall 125.

As a result, the end portion seal member 155 hermetically contacts the blade seal member 57 further strongly, so that the toner sealing force can be further improved.

Similarly as in First Embodiment, as shown in FIG. 18, a region in which the urging portion 37*a* urges the end portion seal member 155 is provided in a region overlapping with the developing blade 42 with respect to the rotational axis direction of the developing roller 32. As a result, the urging portion 37*a* can urge a region close to the surface 155*b* of the end portion seal member 155. For this reason, the end portion seal member 155 hermetically contacts the blade seal member 57 further strongly, so that the toner sealing force can be further improved.

Modified Embodiments

The preferred embodiment of the present invention was described above, but the present invention is not limited thereto. Various modifications and changes of constitutions of the present invention are possible within the scope of the present invention.

Modified Embodiment 1

In the above-described embodiments, description was made using the developing roller 32 as the rotatable member and the developing blade 42 as the blade member, but a similar toner sealing constitution may also be applied to a constitution in which the drum 62 is used as the rotatable member and the cleaning blade 77 is used as the blade member. The cleaning blade 77 is used for removing a foreign matter such as the toner or paper dust (powder) deposited on the surface of the drum 62.

As a result, the present invention may be the process cartridge including the developing unit 20 and the cleaning unit 60 shown in FIG. 3 and may also be a cartridge including either one of the developing unit 20 and the cleaning unit 60. In that case, as regards the cartridge including only the developing unit 20, the present invention is applicable to a cartridge including only the developing roller 32 as the rotatable member and only the developing blade as the blade member.

Further, as regards the cartridge (process cartridge) including only the cleaning unit 60, the present invention is applicable to a cartridge including the photosensitive drum as the rotatable member and only the cleaning blade as the blade member.

Incidentally, as regards the process cartridge including the developing unit 20 and the cleaning unit 60, the present invention is applicable to a process cartridge including the developing roller 32 and the photosensitive drum as the rotatable member and at least one of the developing blade and the cleaning blade as the blade member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-007070 filed on Jan. 18, 2016, which is hereby incorporated by reference herein in its entirety.

What is claimed is:

1. A cartridge detachably mountable to a main assembly of an image forming apparatus, the cartridge comprising:

a frame;

a rotatable member for carrying developer, the rotatable member being supported by the frame;

a blade member contacting the rotatable member;

a first seal member provided between the blade member and the frame, the first seal member extending in a rotational axis direction of the rotatable member, the first seal member being configured to seal a gap between the blade member and the frame, and the first seal member including an extending portion at a longitudinal end portion thereof, the extending portion extending in a crossing direction that crosses the rotational axis direction of the rotatable member; and a second seal member provided between the rotatable member and the frame, the second seal member extending in the crossing direction, the second seal member contacting the rotatable member and the frame, the second seal member being configured to seal a gap between the rotatable member and the frame, and the second seal member including a first surface contacting the extending portion of the first seal member, wherein the frame includes a second surface opposite of the first surface of the second seal member across the extending portion of the first seal member in the rotational axis direction of the rotatable member, the second surface sandwiching the extending portion of the first seal member with the first surface of the second seal member in the rotational axis direction of the rotatable member.

2. A cartridge according to claim 1, further comprising an urging portion for urging the second seal member toward the extending portion of the first seal member.

3. A cartridge according to claim 1, wherein a direction in which the first surface of the second seal member extends and a direction in which the second surface of the frame extends cross each other.

4. A cartridge according to claim 1, wherein the first seal member is an elastic member.

5. A cartridge according to claim 1, wherein the rotatable member is a developing roller for supplying the developer to an image bearing member, and the blade member is a developing blade for regulating a thickness of a layer of the developer on the rotatable member.

6. A cartridge according to claim 5, further comprising a photosensitive member as the image bearing member.

7. A cartridge according to claim 1, wherein the rotatable member is a photosensitive drum, and the blade member is a cleaning blade for removing foreign matter from a surface of the rotatable member.

8. A cartridge according to claim 1, wherein the direction in which the first surface extends is a direction inclined with respect to the rotational axis direction of the rotatable member.

9. A cartridge according to claim 1, wherein the direction in which the second surface extends is a direction inclined with respect to the rotational axis direction of the rotatable member.

10. A cartridge according to claim 1, wherein the frame includes a bearing surface for supporting the first seal member and a wall that projects toward the blade member relative to the bearing surface and on which the second surface is formed, and wherein the wall and the blade member do not contact each other.

11. A cartridge according to claim 1, wherein a direction in which the extending portion of the first seal member extends is a direction along a direction in which the second seal member extends.

* * * * *